US008752819B2

(12) United States Patent
Sato et al.

(10) Patent No.: US 8,752,819 B2
(45) Date of Patent: Jun. 17, 2014

(54) SHEET PROCESSING APPARATUS

(75) Inventors: Tomoharu Sato, Abiko (JP); Hitoshi Kato, Toride (JP); Naoki Ishikawa, Kashiwa (JP); Yasuo Fukatsu, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/469,442

(22) Filed: May 11, 2012

(65) Prior Publication Data

US 2012/0286469 A1 Nov. 15, 2012

(30) Foreign Application Priority Data

May 12, 2011 (JP) ..... 2011-107231
Apr. 24, 2012 (JP) ..... 2012-099007

(51) Int. Cl.
*B65H 31/34* (2006.01)
*B65H 9/08* (2006.01)

(52) U.S. Cl.
USPC ..... 270/58.17; 270/58.12; 270/58.27

(58) Field of Classification Search
USPC ..... 270/58.07, 58.11, 58.12, 58.17, 58.27; 271/220
See application file for complete search history.

(56) References Cited

U.S. PATENT DOCUMENTS

| | | | | |
|---|---|---|---|---|
| 5,791,644 | A * | 8/1998 | Regimbal et al. | 270/58.12 |
| 6,799,759 | B1 * | 10/2004 | McNamara et al. | 270/58.08 |
| 7,392,983 | B2 * | 7/2008 | Kodama et al. | 271/249 |
| 7,883,086 | B2 * | 2/2011 | Kamiya | 271/220 |
| 7,896,338 | B2 * | 3/2011 | Kamiya | 271/220 |
| 7,922,165 | B2 * | 4/2011 | Kamiya | 270/58.17 |
| 8,393,616 | B2 * | 3/2013 | Kubota et al. | 271/220 |

FOREIGN PATENT DOCUMENTS

JP 2009-126592 A 6/2009

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus that is capable of aligning sheets in a sheet longitudinal direction with high accuracy when bundling the sheets. A conveyance unit conveys a sheet. A stacking unit stacks a plurality of sheets that are conveyed by the conveyance unit. A grasping member performs a grasping operation that grasps the rear end of the sheet surface of the sheets stacked on the stacking unit. A driving unit moves the grasping member. A control unit controls the driving unit so as to align the sheets stacked on the stacking unit in a sheet conveyance direction by making the grasping member contact the rear end of the stacked sheets after the sheets are stacked on the stacking unit, and controls the driving unit so that the grasping member performs the grasping operation when a following sheet is stacked on the stacked sheets.

9 Claims, 9 Drawing Sheets

SHEET PROCESSING APPARATUS

BACKGROUND OF THE INVENTION

1. Field of the Invention

The present invention relates to a sheet processing apparatus that processes stacked sheets.

2. Description of the Related Art

A sheet processing apparatus, which bundles sheets on which images are formed by an image forming apparatus (a printer) and then makes the sheets into a book form by binding and folding the sheets, is known. For example, there is a sheet processing apparatus that sequentially receives sheets by a tray, aligns the sheets into a bundle, binds the sheet bundle at a position near the center, pushes the sheet bundle into a nip of a folding roller pair by poking with a pushing member, and folds the sheet bundle by the folding roller pair during conveyance.

In such a process that makes sheets into a book form by binding and folding a sheet bundle, it is necessary to align the sheets in a longitudinal direction (a sheet conveyance direction) and a width direction (a direction parallel to a sheet surface and perpendicular to the sheet conveyance direction) when bundling the sheets. For example, a conventional method stops the front ends of sheets conveyed by a sheet positioning member, and aligns the sheets in the sheet longitudinal direction according to the inertia force of the sheets for aligning the sheets in the sheet longitudinal direction (see Japanese Laid-Open Patent Publication (Kokai) No. 2009-126592 (JP 2009-126592A)).

However, the above-mentioned sheet alignment method may not be able to align shin sheets with small basis weight in the sheet longitudinal direction correctly because of the small inertia force. Since coated paper sheets with smooth surface quality tend to stick each other, the sheets are not correctly adjusted in the sheet longitudinal direction when the inertia force of the sheets does not exceed the force of sticking sheets.

SUMMARY OF THE INVENTION

The present invention provides a sheet processing apparatus that is capable of adjusting sheets in a sheet longitudinal direction with high accuracy when bundling the sheets.

Accordingly, a first aspect of the present invention provides a sheet processing apparatus comprising a conveyance unit configured to convey a sheet, a stacking unit configured to stack a plurality of sheets that are conveyed by the conveyance unit, a grasping member configured to perform a grasping operation that grasps the rear end of the sheet surface of the sheets stacked on the stacking unit, a driving unit configured to move the grasping member, and a control unit configured to control the driving unit so as to align the sheets stacked on the stacking unit in a sheet conveyance direction by making the grasping member contact the rear end of the stacked sheets after the sheets are stacked on the stacking unit, and to control the driving unit so that the grasping member performs the grasping operation when a following sheet is stacked on the stacked sheets.

Accordingly, a second aspect of the present invention provides a sheet processing apparatus comprising a conveyance unit configured to convey a sheet, a stacking unit configured to stack a plurality of sheets that are conveyed by the conveyance unit, a dividing member configured to divide the following sheet from the stacked sheet when the following sheet is stacked after the sheet is stacked on the stacking unit, a moving unit configured to move the dividing member to divide the sheets, and a control unit configured to control the moving unit so that the dividing member contacts the rear end of the sheet for aligning the sheet in a sheet conveyance direction.

According to the present invention, the sheets are aligned in the sheet longitudinal direction with high accuracy when bundling the sheets, which improves quality of the sheet treatment process.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
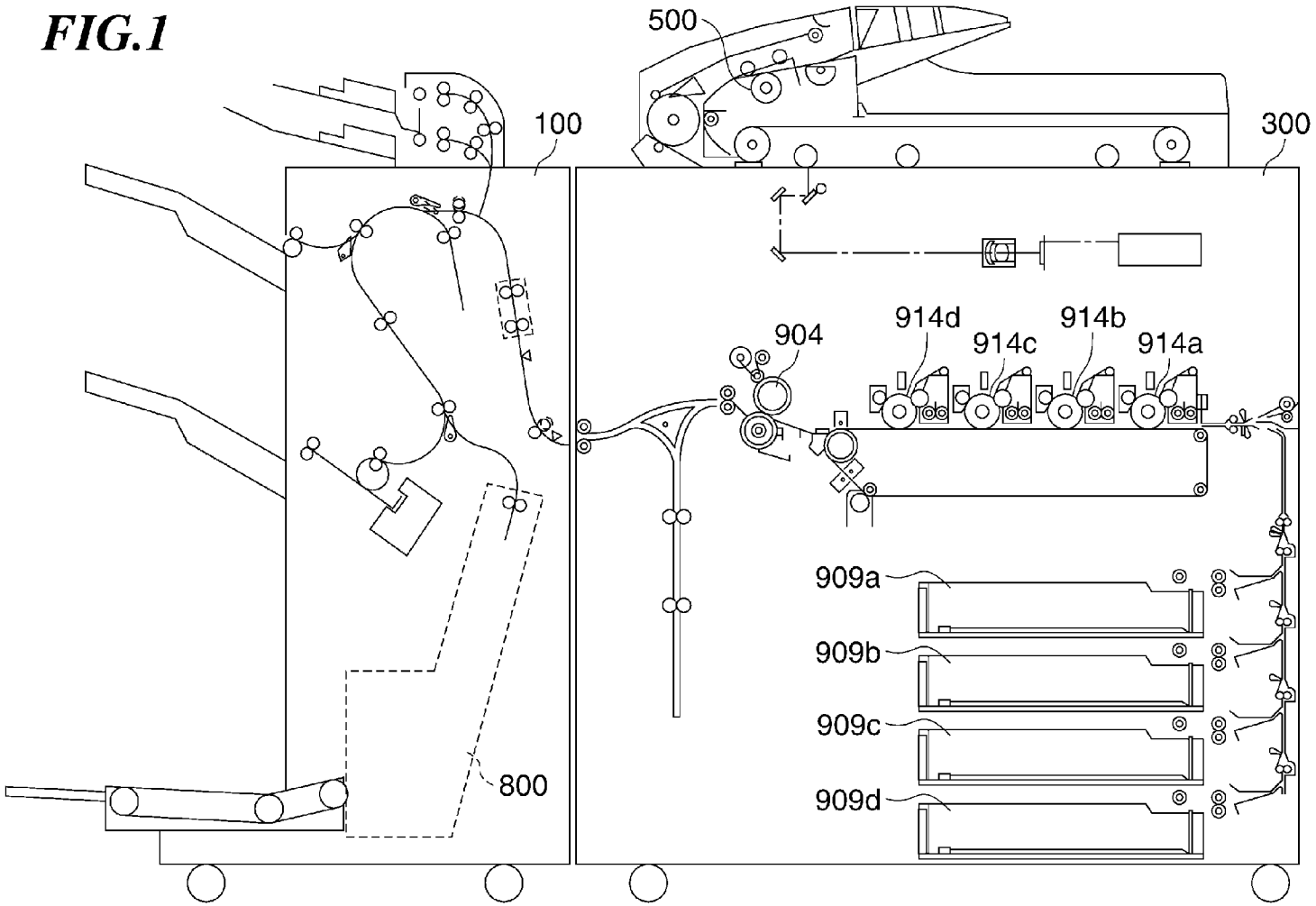
FIG. 1 is a sectional view schematically showing a configuration of an image forming system including a sheet processing apparatus according to an embodiment of the present invention.

FIG. 1 is a sectional view schematically showing a configuration of an image forming system including a sheet processing apparatus according to an embodiment of the present invention. This image forming system is provided with an image forming apparatus 300, an automatic original feeding device 500, and the sheet processing apparatus 100. The sheet processing apparatus 100 is connected to the image forming apparatus 300, and is provided with a saddle stitching unit 800 and a sheet stacking unit (a side stitching unit). It should be noted that the sheet processing apparatus 100 and the image forming apparatus 300 may form a single unit.

The image forming apparatus 300 is provided with cassettes 900*a*, 900*b*, 900*c*, and 900*d* that accommodate various types of sheets (paper sheets). Photosensitive drums 914*a*, 914*b*, 914*c*, and 914*d* of yellow, magenta, cyan, and black transfer toner images of the respective colors onto a sheet that is fed from one of the cassettes 900*a* through 900*d*. The sheet on which the toner images are transferred is conveyed to a fixing unit 904, the toner images are fixed to the sheet, and then the sheet is ejected to the sheet processing apparatus 100. It should be noted that a well-known configuration is applicable to the image forming apparatus 300.

Figure 2:
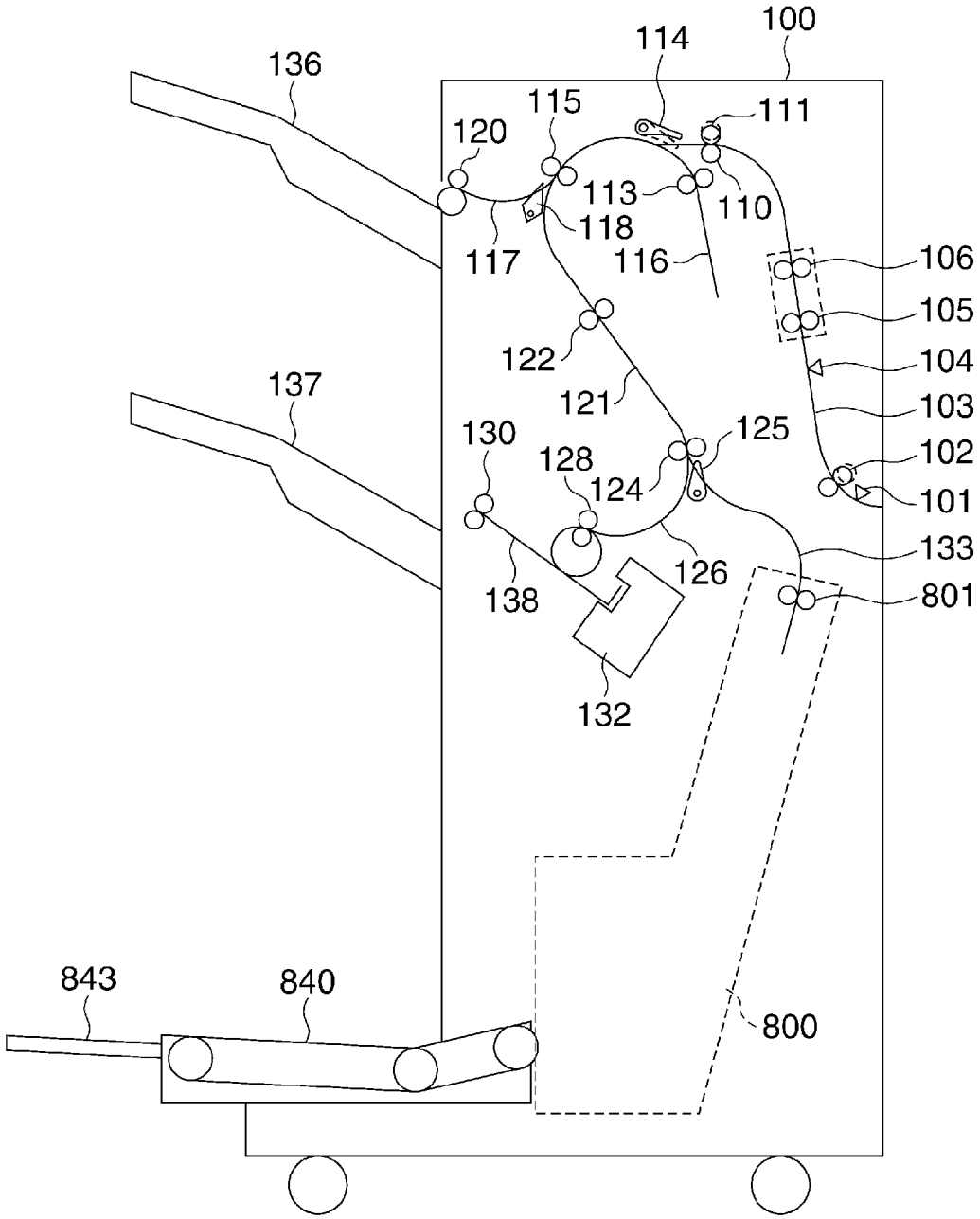
FIG. 2 is a side view showing a configuration of the sheet processing apparatus shown in FIG. 1.

FIG. 2 is a side view schematically showing a configuration of the sheet processing apparatus 100. Here, the configuration of the sheet processing apparatus 100 will be described along a conveyance path of a sheet. It should be noted that a control system of the image forming apparatus 100 will be described with reference to FIG. 2 later.

The sheet ejected from the image forming apparatus 300 is received and passed to an entrance conveying roller pair 102 of the sheet processing apparatus 100. The entrance conveying roller pair 102 is driven by an entrance conveying motor driver and an entrance conveying motor that are not shown. Transfer timing of the sheet from the image forming apparatus 300 to the sheet processing apparatus 100 is detected by an entrance sensor 101.

The sheet conveyed by the entrance conveying roller pair 102 passes through a conveyance path 103, and is received and passed to a first shift conveying roller pair 105 and a second shift conveying roller pair 106. The first shift conveying roller pair 105 and the second shift conveying roller pair 106 are driven by a shift conveyance motor driver and a shift conveying motor that are not shown.

An end position in a width direction (a direction perpendicular to a sheet conveyance direction) of the sheet conveyed by the first shift conveying roller pair 105 and the second shift conveying roller pair 106 is detected by a horizontal registration sensor 104. A horizontal shift amount of the sheet is calculated based on the end position of the sheet in the width direction detected by the horizontal registration sensor 104, and the sheet is moved in the width direction so to correct the horizontal shift (a horizontal registration correction). A well-known technique can be used for this horizontal registration correction. The sheet processing apparatus 100 performs the horizontal registration correction by the first shift conveying roller pair 105 and the second shift conveying roller pair 106 during conveyance of a sheet.

The sheet to which the horizontal registration correction has been applied is conveyed by a conveying roller 110, a spacing roller 111 and a first buffer roller pair 115, and is conveyed to an upper conveyance path 117 or a bunch conveyance path 121. When guiding a sheet to the upper conveyance path 117, an upper path switching flapper 118 will be in a broken line state in FIG. 2 by a solenoid (not shown), and a sheet will be ejected by an upper ejecting roller 120 to an upper tray 136. On the other hand, when guiding a sheet to the bunch conveyance path 121, the upper path switching flapper 118 will be in a solid line state in FIG. 2, and sheets are sequentially conveyed by a second buffer roller pair 122 and a bundle conveying roller pair 124 to a downstream side in the sheet conveyance direction.

If needed, the buffer roller pair 115 rotates in the reverse of the sheet conveyance direction, and a sheet is conveyed to a buffer path 116 by a flapper 114 and a buffer roller pair 113. Accordingly, the sheet is retained in the buffer path 116. The sheet that is retained in the buffer path 116 is sent out by the buffer roller pair 114 in synchronization with conveyance of the following sheet, is overlapped with the following sheet and is conveyed. This conveyance operation is called a buffering operation. While the process to a sheet bundle is performed by the below-mentioned intermediate processing tray 138 and the saddle stitching unit 800, the buffering operation is executed in order to convey a following sheet to neither the intermediate processing tray 138 nor the saddle stitching unit 800. The number of the sheets stacked by the buffer operation is determined based on time required by a process performed on the intermediate processing tray 138 or a process performed by the saddle stitching unit 800.

When performing a saddle stitching process for sheets, the saddle path switching flapper 125 is in a broken line state in FIG. 2 by the solenoid (not shown), and a sheet is conveyed to a saddle path 133 and is guided to the saddle stitching unit 800 by a saddle entrance roller pair 801.

On the other hand, when not performing the saddle stitching process for sheets, the saddle path switching flapper 125 is in a solid line state in FIG. 2 by the solenoid (not shown), and a sheet is sent to a conveyance path 126 and is ejected by the intermediate processing tray 138 by a lower ejecting-roller pair 128. Then, a sheet aligning process is performed by a return mechanism, such as a puddle and a knurled belt (not shown), on the intermediate processing tray 138. After the saddle stitching process is given by a stapler 132 as needed to a sheet bundle, the sheet bundle is ejected to a lower tray 137 by a bundle ejecting-roller pair 130.

Figure 3:
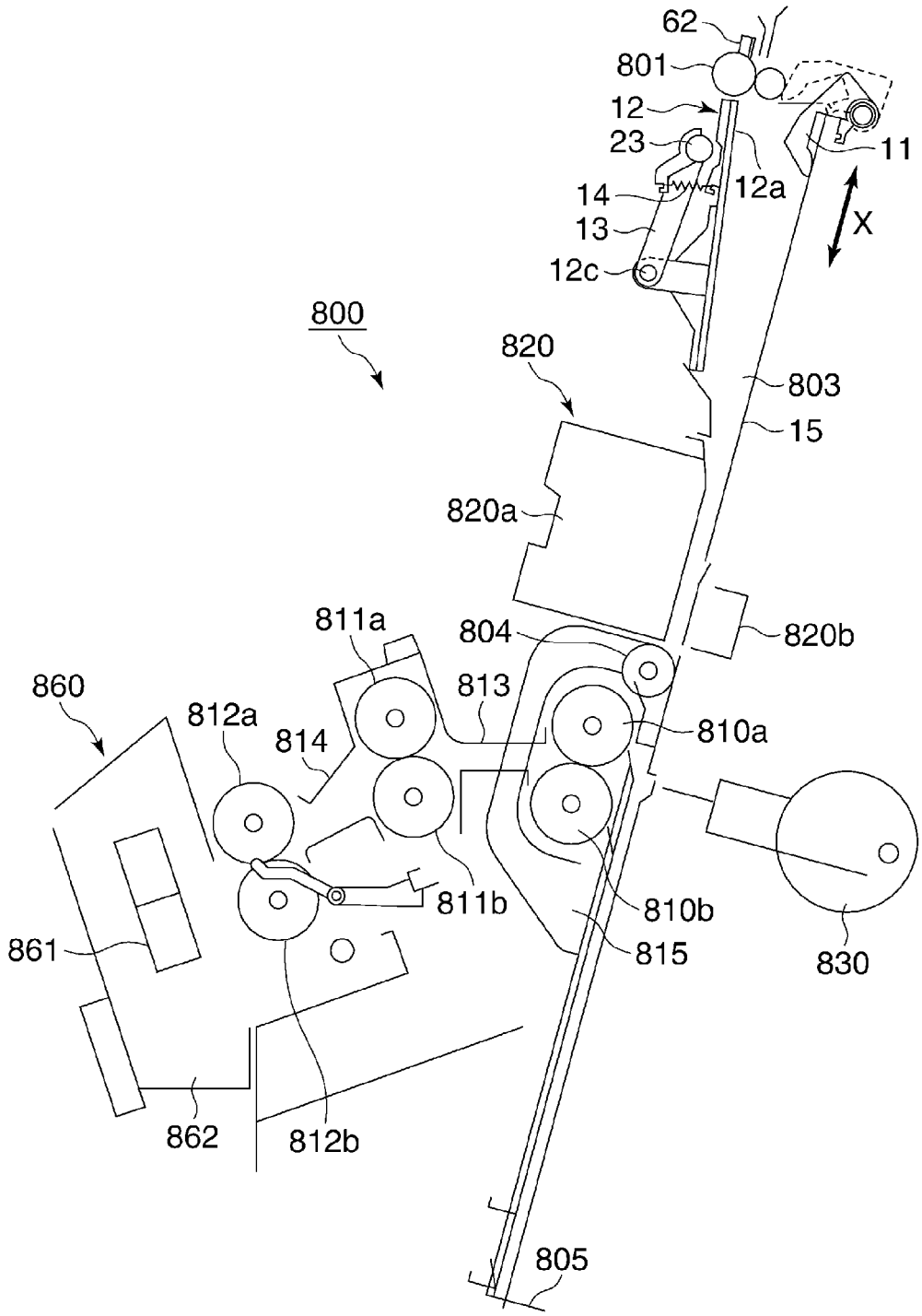
FIG. 3 is a side view showing a configuration of a saddle stitching unit with which the sheet processing apparatus in FIG. 2 is provided.

FIG. 3 is a side view schematically showing a configuration of the saddle stitching unit 800. Here, the configuration of the saddle stitching unit 800 will be described along a conveyance path of a sheet.

When the saddle path switching flapper 125 is in the broken line state in FIG. 2 as mentioned above, a sheet is conveyed to the saddle path 133 and is guided to the saddle stitching unit 800 by the saddle entrance roller pair 801. As shown in FIG. 3, a saddle entrance sensor 62 is arranged near the entrance of the saddle stitching unit 800 to detect a sheet carried into the saddle stitching unit 800. The saddle entrance roller pair 801 is driven to rotate by a conveyance motor M1 (see FIG. 7).

A plurality of holding members 12 that press down a sheet to a sheet stacking plate 15 are arranged opposite to the sheet stacking plate 15 across the sheet conveyance path directly under the saddle entrance roller pair 801 (at the downstream side in the sheet conveyance direction). It should be noted that the sheet stacking plate 15 inclines in the sheet conveyance direction as clearly shown in FIG. 3. Therefore, a sheet that passes through the saddle entrance roller pair 801 is stacked on the sheet stacking plate by inertia force and gravity. The details of the holding members 12 will be described later.

At the downstream side of the holding members 21 in the sheet conveyance direction, a storage guide 803 is arranged as a stacking unit on which a plurality of sheets are stacked. A stapler 820 is arranged at the midpoint of the storage guide 803 at the both sides of the storage guide 803. The stapler 820 comprises a driver 820*a* that projects a needle, and an anvil 820*b* that bends the projected needle. The driver 820*a* is driven by a staple motor M7 (see FIG. 7).

A conveying roller 804 is arranged directly under the stapler 820 (at the downstream side in the sheet conveyance direction). The conveying roller 804 is driven to rotate with the saddle entrance roller pair 801 by the conveyance motor M1 (see FIG. 7). The conveying roller 804 can contact a sheet or can be separated from a sheet at a predetermined timing by a driving source (not shown).

A sheet positioning member 805 is arranged at the downstream side in the sheet conveyance direction of the conveying roller 804. The sheet positioning member 805 catches a front end in the gravity direction (an end of the downstream side in the sheet conveyance direction in this case) of a sheet that is carried into the storage guide, and moves in the sheet conveyance direction to move the sheet so that the staple process is performed at the center area of the sheet in the sheet longitudinal direction (the sheet conveyance direction). That is, the sheet positioning member 805 moves up and down by a positioning motor M2 (see FIG. 7) so that the center of the sheet bundle agrees with the stitch position by the stapler 820 according to a sheet size.

When aligning the sheets in their longitudinal direction by hitting the front ends of the sheets against the sheet positioning member 805, the positions of the rear ends (edges of the upstream side in the sheet conveyance direction) of the sheets vary with the sheet size. Therefore, moving members 11 (one of the members is illustrated in FIG. 3), which align a sheet in the conveyance direction, are arranged above the storage guide 803 so as to move in the up-and-down direction shown by an arrow X in FIG. 3 according to the sheet size. The details of the operation of the moving members 11 will be described later with reference to FIG. 5A and FIG. 5B.

First folding rollers 810*a* and 810*b* are arranged on the downstream side of the conveying roller 804 in the sheet conveyance direction, and an ejector member 830 is arranged so as to face to the first folding rollers 810*a* and 810*b*. The ejector member 830 waits at a home position distant from the storage guide 803 when it is not driven. The ejector member 830 is projected towards the sheet bundle supported by the sheet positioning member 805 when driven by an ejector motor M3 (see FIG. 7), pushes a sheet bundle into the nip of the first folding rollers 810*a* and 810*b*, and then returns to the home position.

When folding a sheet bundle that was stitched by the stapler 820, the sheet positioning member 805 takes the sheet bundle down in a predetermined distance from the position at the staple process so as to agree the staple position of the sheet bundle with the nip position of the first folding rollers 810*a* and 810*b*. In this way, the sheet bundle is folded along the center stitched by the stapler 820.

An alignment plate pair 815, which aligns (locates) the sheets accommodated by the storage guide 803 in the width direction, is arranged so as to surround the first folding rollers 810*a* and 810*b*. The alignment plate pair 815 is driven by an alignment-plate motor M5 (see FIG. 7), and aligns the sheets in the width direction by pinching the sheet bundle in the width direction.

A spring (not shown) applies a tension to the first folding rollers 810*a* and 810*b* in the direction close to each other so as to give a force sufficient to fold a sheet bundle. The sheet bundle folded by the first folding rollers 810*a* and 810*b* is ejected onto a conveyor belt 840 shown in FIG. 2 via second folding rollers 811*a* and 811*b* and third folding rollers 812*a* and 812*b*. It should be noted that a tension is applied to each of the second folding roller 811*a* and 811*b* and the third folding rollers 812*a* and 812*b* in the direction close to each other so as to give a force sufficient to convey and stop the folded sheet bundle.

A conveyance guide 813 is arranged between the first folding rollers 810*a* and 810*b* and the second folding rollers 811*a* and 811*b*, and a conveyance guide 814 is arranged between the second folding rollers 811*a* and 811*b* and the third folding rollers 812*a* and 812*b*. These conveyance guides 813 and 814 guide a sheet bundle. The first folding rollers 810*a* and 810*b*, the second folding rollers 811*a* and 811*b*, and the third folding rollers 812*a* and 812*b* pinch the folded sheet bundle from both sides, and rotate at uniform velocity by a folding motor M4 (see FIG. 7).

A fold press unit 860 is arranged at the downstream side of the third folding roller 812*a* and 812*b* in the sheet conveyance direction. The fold press unit 860 is provided with a press roller pair 861 and a press holder 862 that supports the press roller pair 861. The press roller pair 861 is driven by a press motor M8 (see FIG. 7).

A fold is strengthened by moving the press holder 862 toward a folding edge of the folded sheet bundle while nipping the sheet bundle by the press roller pair 861. The conveyor belt 840 shown in FIG. 2 is arranged directly under the fold press unit 860 (at the downstream side in the sheet conveyance direction), and the conveyor belt 840 ejects and stacks sheet bundles onto the ejection tray 843 (see FIG. 2). It should be noted that the conveyer belt 840 is driven by a conveyor motor M9 (see FIG. 7).

The holding member 12 shown in FIG. 3 is in an escape position. FIG. 4A through FIG. 4D are views showing operation states of the holding member 12, and show an holding operation in which the holding member 12 moves from the escape position toward the sheet stacking plate 15 and presses the sheets caught by the sheet positioning member 805 to the sheet stacking plate 15.

The upper part (the end at the upstream side in the sheet conveyance direction) of the holding member 12 is energized with the spring 14 supported by the support member 13 in the direction of going away from the sheet stacking plate 15. The support member 13 is fixed to a rotating shaft 23. The holding motor M6 (see FIG. 7) transfers power to the rotating shaft 23 through a drive transmission mechanism (not shown) to move the holding member 12 via the support member 13.

Figure 4A:
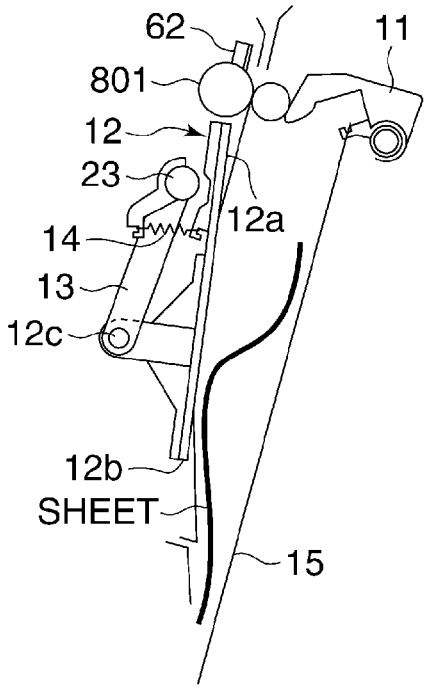
FIG. 4A through FIG. 4D are views showing an operation state of a holding member with which the saddle stitching unit in FIG. 3 is provided.
Figure 4B:
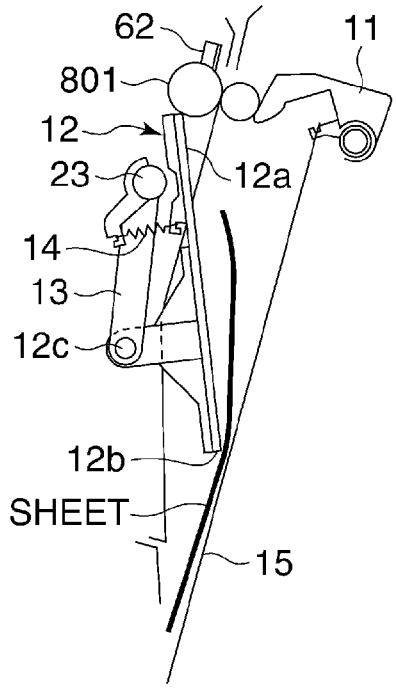

Since the upper part of the holding member 12 is pulled by the spring 14, the lower part 12*b* of the holding member 12 contacts a sheet first when the support member 13 and the holding member 12 are rotated as shown in FIG. 4A. When the support member 13 rotates more, the holding member 12 also starts to rotate around the rotating shaft 12*c* against the tension of the spring 14. Accordingly, since the holding member 12 gradually presses a swelling of a sheet upwardly from the bottom, the swelling of the sheet caused as shown in FIG. 4A moves upwardly to the top edge (the rear end in the conveyance direction) and then disappears as shown in FIG. 4B.

Figure 4C:
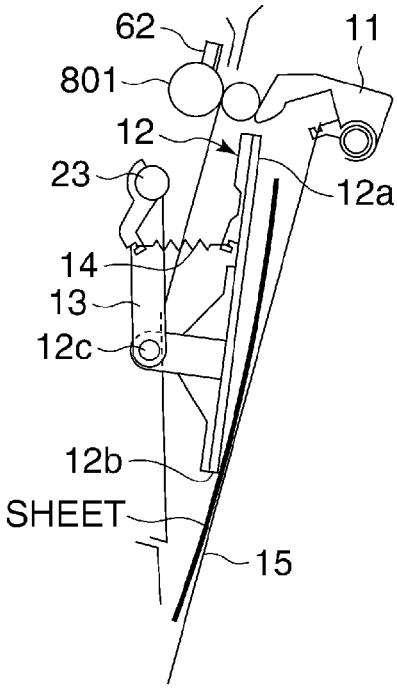
Figure 4D:
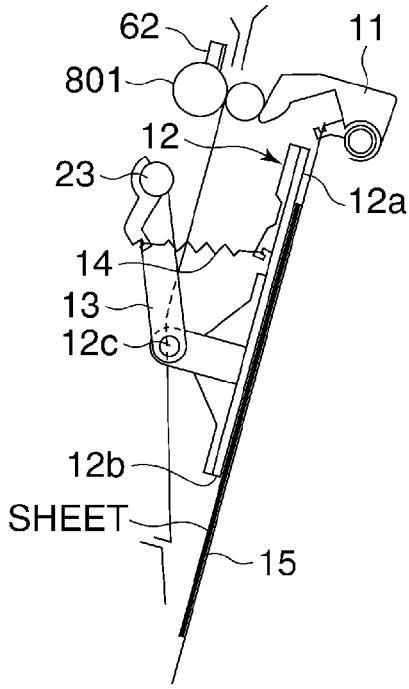

When the support member 13 rotates more, as shown in FIG. 4C and FIG. 4D, the holding member 12 rotates around the rotating shaft 12*c*, a holding surface 12*a* of the holding member 12 presses the sheet to the sheet stacking plate 15, and the sheet is fixed. In this way, the swelling of the sheet can be reduced.

Figure 5A:
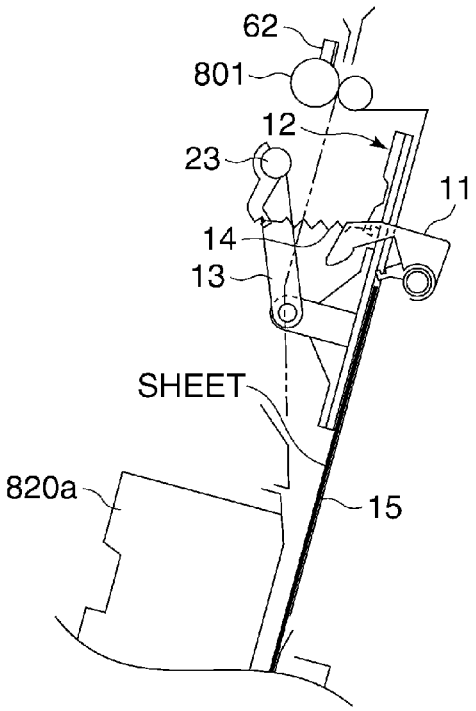
FIG. 5A and FIG. 5B are views showing an example of an operation state of moving members with which the saddle stitching unit in FIG. 3 is provided.
Figure 5B:
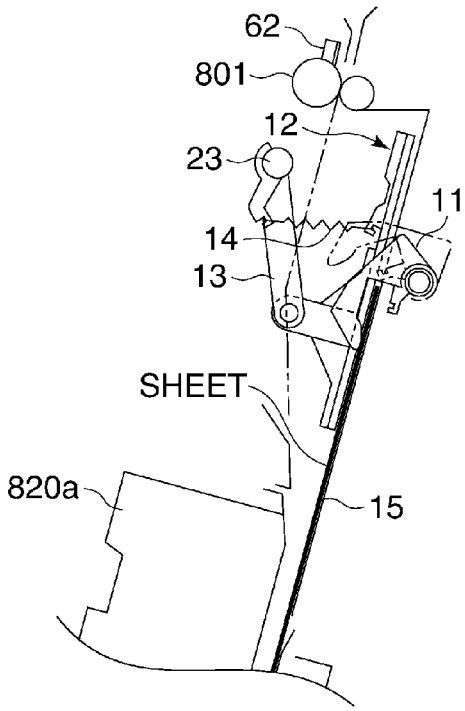

FIG. 5A and FIG. 5B are views showing an example of an operation state of the moving members 11. Before a first sheet of a sheet bundle is carried into the storage guide 803, the moving members 11 wait in the escape position that do not interrupt the conveyance of a sheet, as shown in FIG. 4A through FIG. 4D.

Figure 6:
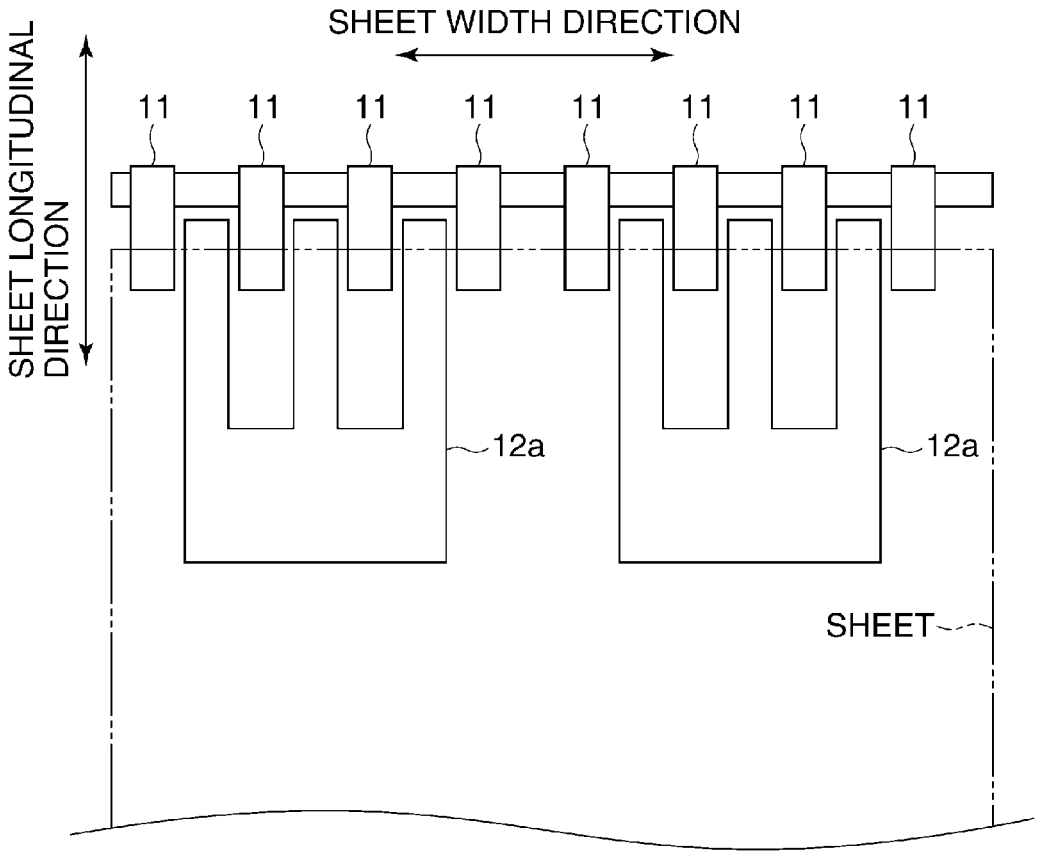
FIG. 6 is a view schematically showing relation between the holding member and the moving members with which the saddle stitching unit in FIG. 3 is provided.

FIG. 6 is a view schematically showing relation between the holding member 12 and the moving members 11. The moving members 11 are arranged in the sheet width direction, and grasp a sheet by rotating and pinching the end of the sheet with the sheet stacking plates 15. The holding surface 12*a* of the holding member 12 and the moving members 11 are designed like a comb in a plane view so that they do not interfere (contact) mutually.

As shown in FIG. 5A, when the first sheet of the sheet bundle is pushed against the sheet stacking plate 15 by the holding member 12, the moving members 11 move to the downstream side in the sheet conveyance direction from the escape position. The moving members 11 rotate from a broken line state to a solid line state shown in FIG. 5B, while the holding member 12 pushes the sheet against the sheet stacking plate 15. Accordingly, the front ends of the moving members 11 grasp the rear end of the sheet stacked on the sheet stacking plate 15 (a grasping operation). It should be noted that the force of the moving members 11 to grasp a sheet is given by a spring (not shown).

Since the alignment of sheets of a sheet bundle in the longitudinal direction will be described later in detail with reference to FIG. 8 and FIG. 9A through FIG. 9C, a schematic operation of the moving members 11 will be described in conjunction with an operation of the holding member 12 here.

Before the saddle entrance roller pair 801 conveys a second sheet into the storage guide 803, the holding member 12 returns from the position pushing the sheet shown in FIG. 4D to the escape position shown in FIG. 3 so as not to disturb the conveyance (an escape operation). Then, the moving members 11 keep the sheet that has been already grasped pressing until the conveying roller 804 contacts the second sheet conveyed. The moving members 11 divide a stacked sheet from a next sheet in order to prevent a collision between the rear end of the stacked sheet and the front end of the next sheet conveyed to the storage guide 803, or to prevent an insertion of the next sheet under the stacked sheet. It should be noted that the movements of the moving members 11 to positions that can divide the sheets are enough even if the moving members 11 do not contact the sheet surface.

When the holding member 12 starts the holding operation that pushes the second sheet against the sheet stacking plate 15, the moving members 11 rotate so as to separate from the grasped sheet (a release operation). When the holding operation for the sheet by the holding member 12 is completed, the moving members 11 grasp the sheet bundle stacked on the sheet stacking plate 15 (a grasping operation). Operations of the holding member 12 and the moving members 11 that carry the third and subsequent sheets into the storage guide 803 are identical to the operations that carry the second sheet into the storage guide 803.

The moving members 11 contact the rear end of the sheet bundle accommodated by the storage guide 803 (a contact operation) in an open state after the release operation that releases the sheet. That is, the moving members 11 perform the contact operation after performing the release operation. This contact operation pushes a sheet (or a sheet bundle) from the rear side to the front side, and aligns sheets in the sheet conveyance direction. This operation will be described later in detail with reference to FIG. 9A through FIG. 9C. The operations of the moving members 11 and the holding member 12 are controlled so that the holding operation by the holding member 12 completes after completion of the contact operation by the moving members 11.

Figure 7:
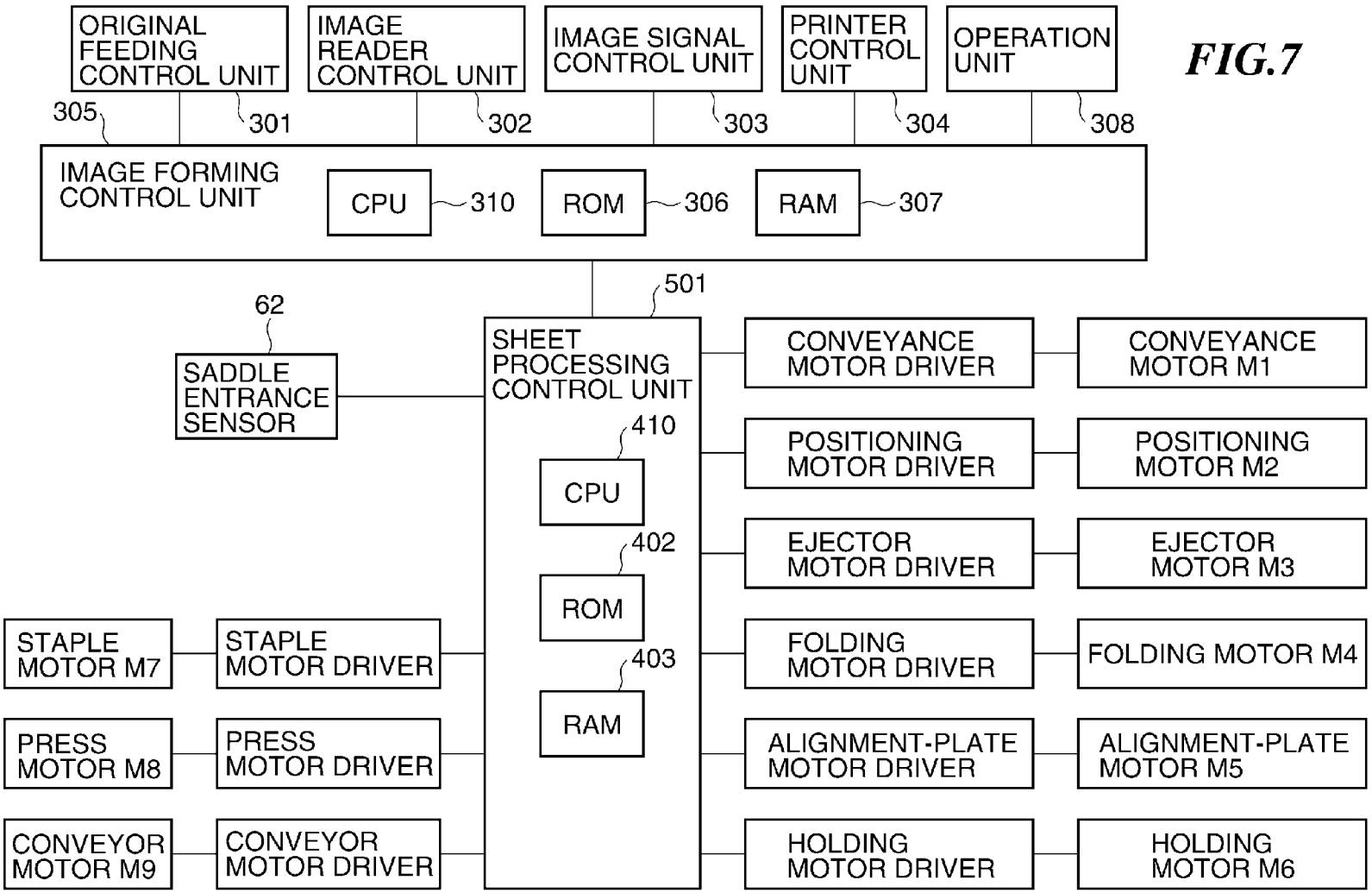
FIG. 7 is a block diagram schematically showing a control system of the image forming system in FIG. 1.

FIG. 7 is a block diagram schematically showing a control system of the image forming system. An image forming control unit 305 that controls the image forming apparatus 300 has a CPU 310, a ROM 306, and a RAM 307. The CPU 310 develops a control program stored in the ROM 306 onto a working area of the RAM 307 and executes the program. The image forming control unit 305 totally controls an original feeding control unit 301, an image reader control unit 302, an image signal control unit 303, a printer control unit 304, an operation unit 308, and a sheet processing control unit 501. It should be noted that the RAM 307 temporarily stores control data etc.

The original feeding control unit 301 controls feeding of an original in an automatic original feeding device 500 (see FIG. 1). The image reader control unit 302 controls optical reading of the document surface. The image signal control unit 303 converts an image signal (an analog RGB image signal) read from an original into a digital signal, performs various kinds of data processing (image processing), and outputs the processed digital signal (image signal) to the printer control unit 304.

The printer control unit 304 controls driving of the photosensitive drums 914*a* through 914*d* for respective colors, etc. to print an image on a sheet based on the received image signal. The operation unit 308 includes various keys and an operation panel for setting contents of a job executed by the image forming system, a display panel, etc. Information inputted through the operation unit 308 is sent to the image forming control unit 305, and the display panel displays set information and progress state of the job based on the signals from the image forming control unit 305.

The sheet processing control unit 501 is mounted in the sheet processing apparatus 100, performs data communication with the image forming control unit 305 via a communication IC (not shown), and controls operations of the sheet processing apparatus 100. The sheet processing control unit 501 has a CPU 410, a ROM 402, and a RAM 403. The CPU 410 develops a control program stored in the ROM 402 to a working area of the RAM 403 and executes the program to process signals from various sensors of the sheet processing apparatus 100, and controls various actuators. It should be noted that the RAM 403 temporarily stores control data etc.

For example, the sheet processing control unit 501 controls the conveyance motor M1 that drives the saddle entrance roller pair 801 and the conveying roller 804 through a conveyance motor driver. The other motors M2 through M9 are controlled by a similar configuration as shown in FIG. 7.

Figure 8:
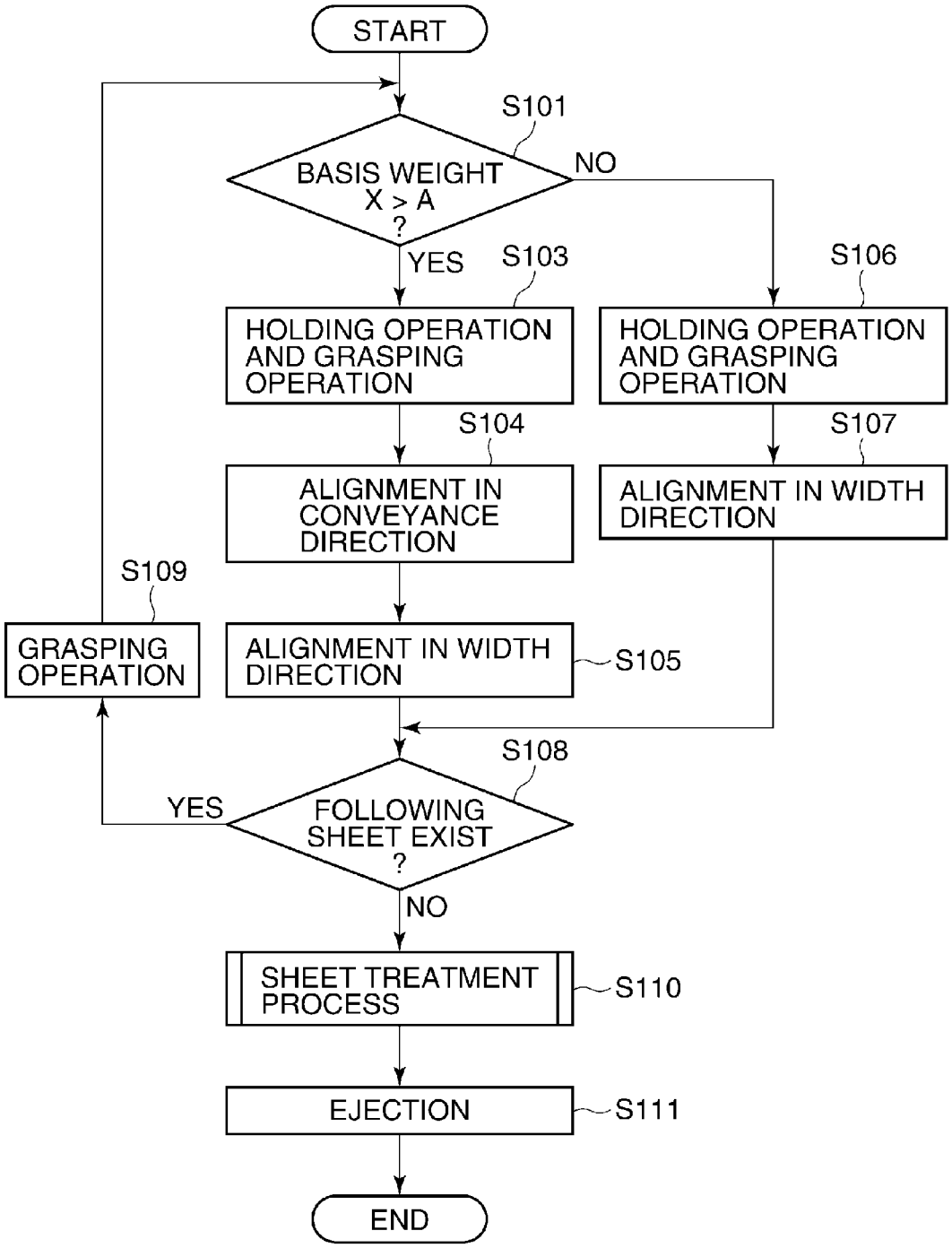
FIG. 8 is a flowchart showing a sheet alignment process in the sheet processing apparatus in FIG. 2.
Figure 9A:
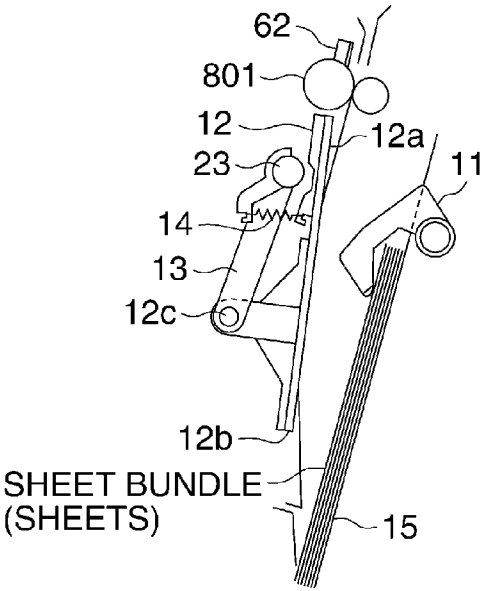
FIG. 9A through FIG. 9C are views showing another example of the operation state of the moving members with which the saddle stitching unit in FIG. 3 is provided.
Figure 9B:
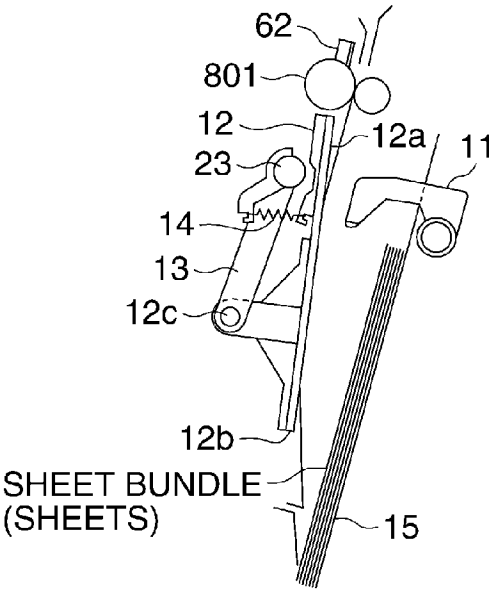
Figure 9C:
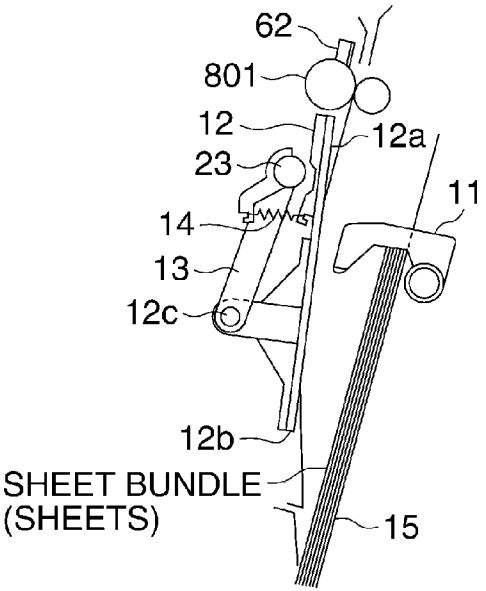

FIG. 8 is a flowchart showing a sheet alignment process in the sheet processing apparatus 100. Here a process from a start of a job concerning a saddle stitch bookbinding to an ejection of a booklet (a sheet bundle that is stitched and folded) that is bound by the predetermined number of sheets after alignment is shown. FIG. 9A through FIG. 9C are views showing another example of an operation state of the moving members 11. Each process shown in the flowchart in FIG. 8 is executed by the CPU 410 with which the sheet processing control unit 501 is provided. Hereafter, the contents of the process according to the flowchart in FIG. 8 will be described with reference to FIG. 5A, FIG. 5B, and FIG. 9A through FIG. 9C.

First, the CPU 410 determines whether the basis weight X of the sheet on which an image is formed is larger than a predetermined value A (step S101). In the step S101, the CPU 410 obtains the basis weight information, such as sheet information set in the image forming apparatus 300, a detection value by a sensor (not shown), a value set by a user through the operation unit, using a communication means (not shown), and compares it with the predetermined value A.

When aligning a thin (small basis weight) and feeble sheet in the conveyance direction, the sheet may buckle and dents of the moving members 11 that grasp the sheet may remain. In order to avoid this problem, when the basis weight of the sheet is not larger than the value defined beforehand, the sheet is not aligned by the moving members 11. For example, when the predetermined value A is set to 60 [g/m$^2$] and the basis weight X is not larger than 60 [g/m$^2$] (NO in the step S101), the CPU 410 proceeds with the process to step S106. On the other hand, when the basis weight X exceeds 60 [g/m$^2$] (YES in the step S101), the CPU 410 proceeds with the process to step S103. It should be noted that the predetermined value A can be set experimentally or experientially.

In the step S103, the CPU 410 performs the holding operation for the sheet by the holding member 12 and the grasping operation for the rear end of the sheet by the moving members 11 as described with reference to FIG. 4A through FIG. 4D, FIG. 5A, and FIG. 5B, after the front end of the sheet reaches the front end stopper 805. It is determined whether the front end of the sheet reached the front end stopper 805 by whether predetermined time elapsed after the timing of the detection of the front end of the sheet by the saddle entrance sensor 62. This eliminates a swelling of the sheet. After the step S103, the CPU 410 performs the alignment operation in the longitudinal direction of the sheet bundle (step S104).

Specifically, the CPU 410 retracts the holding member 12 from the state shown in FIG. 5B, and changes to the state as shown in FIG. 9A. Then, the CPU 410 releases the grip of the sheet bundle by the moving members 11 as shown in FIG. 9B, and performs the contact operation that moves the moving members 11 to the downstream side in the sheet conveyance direction and makes the moving members 11 contact the rear end of the sheet bundle as shown in FIG. 9C. In this way, the sheet bundle is aligned by the upper end (the rear end) of the sheet bundle in the longitudinal direction. It should be noted that the number of contacts by the moving member 11 to the sheet bundle is not limited to one time but may be a plurality of times.

When the alignment operation for the sheet bundle in the longitudinal direction is completed, the CPU 410 performs the alignment operation for the sheet bundle in the width direction by driving the alignment-plate motor M5 so as to pinch the sheets by the alignment plate pair 815 (step S105). In this embodiment, the alignment operation in the width direction is performed after performing the alignment operation in the longitudinal direction. However, the order of the operations is not limited to this. The alignment operation in the width direction may be performed first, and both the operation may be performed simultaneously.

In the step S106, the CPU 410 performs the holding operation for the sheet by the holding member 12 and the grasping operation for the rear end of the sheet (or the sheet bundle) by the moving members 11 like the step S103. After the step S106, the CPU 410 performs the alignment operation in the width direction for the sheet (or the sheet bundle) ike the step S105 without aligning the sheet in the longitudinal direction by the moving members 11.

After the step S105 or the S107, the CPU 410 determines whether there is a following sheet (step S108). When there is a following sheet (YES in the step S108), the CPU 410 performs the grasping operation for the sheet (or the sheet bundle) by the moving members 11 in order to divide the following sheet from the stacked sheet as mentioned above (step S109). Specifically, the moving members 11 move to the position shown in FIG. 9A from the position shown in FIG. 9C, and grasp the sheet (or the sheet bundle) as shown in FIG. 9A. When there is no following sheet (NO in the step S108), the CPU 410 performs the sheet treatment process set by the job (5110). For example, the CPU 410 performs the saddle stitching process that stitches the sheet bundle by driving the stapler 820, moves the stitched sheet bundle to the position to be folded by the ejector member 830, and folds the stitched sheet bundle by the folding roller pairs 810*a* and 810*b* to a bifold state. The fold process by the fold press unit 860 is applied to the folded sheet bundle to strengthen the fold.

Then, the CPU 410 ejects the sheet bundle (the booklet) made in the step S110 onto the conveyor belt 840 (step S111), and drives the conveyor belt 840 to eject the sheet bundle to the ejection tray 843. In this way, when the emission of the sheet bundle (the booklet) is completed, the CPU 410 finishes this job. However, when there is a sheet bundle of a next set, the CPU 401 repeats the process from the step S101.

Whenever a plurality of sheets are carried to the storage guide 803, the holding operation by the holding member 12, the grasping operation by the moving members 11, the escape operation of the holding member 12, the release operation of the moving members 11, and the contact operation by the moving members 11 are performed in this order in this embodiment as mentioned above. Accordingly, the moving members 11 perform the alignment operation in the sheet longitudinal direction.

Since this embodiment is capable of aligning sheets with high accuracy according to such a configuration and a method without complicating the structure of the saddle stitching unit 800, the quality of the folded sheet bundle is highly maintainable. Since the alignment operation in the sheet longitudinal direction is not performed when a sheet is thin or the buffered sheet is few in number, the fall of productivity can be prevented.

Although the above mentioned embodiment does not perform the contact operation by the moving members 11 to the thin sheet, the contact operation by the moving members 11 may be performed only to a smooth sheet like a coated paper.

The CPU 410 performs the buffering operation by which the following sheets pile up and are conveyed so that the following sheets are not conveyed to the conveyance guide 803 while performing the staple process or the folding process in the step S110. When the sheet number Y of the sheet piled by this buffering operation is more than the predetermined sheet number B, the contact operation by the moving members 11 may be performed. In this case, the contact operation is performed when the sheets of not less than the predetermined sheet number B are stacked on the saddle stitching unit 800. On the other hand, the contact operation is not performed when the sheets of less than the predetermined sheet number B are stacked on the saddle stitching unit 800 and when the single sheet is stacked on the saddle stitching unit 800. Although the predetermined sheet number B is "2" in this embodiment, it may be "3" or more.

The conditions for performing the contact operation by the moving members 11 mentioned above may be combined, respectively.

Although the embodiments of the invention have been described, the present invention is not limited to the above-mentioned embodiments, the present invention includes various modifications as long as the concept of the invention is not deviated. The embodiments mentioned above show examples of the present invention, and it is possible to combine the embodiments suitably.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-107231, filed on May 12, 2011, and No. 2012-099007, filed on Apr. 24, 2012, which are hereby incorporated by reference herein in their entirety.

What is claimed is:

1. A sheet processing apparatus comprising:

a conveyance unit configured to convey a sheet;

a stacking unit configured to stack a plurality of sheets that are conveyed by said conveyance unit;

a grasping member configured to perform a grasping operation that grasps a sheet surface in a rear end side of the sheets stacked on said stacking unit and a contact operation that contacts a rear end of the stacked sheets;

a driving unit configured to move said grasping member; and a control unit configured to control said driving unit so that said grasping member performs the contact operation after the sheets are stacked on said stacking unit so as to align the sheets stacked on said stacking unit in a sheet conveyance direction, and to control said driving unit so that said grasping member performs the grasping operation when a following sheet is stacked on the stacked sheets, wherein said control unit makes said grasping member perform the grasping operation so as to grasp the sheet surface in the rear end side of the sheet of the stacked sheets when the following sheet is stacked on said stacking unit, and makes said grasping member perform a release operation, which separates from the sheets grasped by the grasping operation, before starting the contact operation.

2. The sheet processing apparatus according to claim 1, wherein said control unit makes said grasping member perform the contact operation to align the sheets stacked on said stacking unit in the sheet conveyance direction.

3. The sheet processing apparatus according to claim 1, wherein said control unit makes said grasping member perform the grasping operation to prevent a collision between the rear end of the sheet stacked on said stacking unit and the front end of the following sheet.

4. A sheet processing apparatus comprising:

a conveyance unit configured to convey a sheet;

a stacking unit configured to stack a plurality of sheets that are conveyed by said conveyance unit;

a grasping member configured to perform a grasping operation that grasps a sheet surface in a rear end side of the sheets stacked on said stacking unit and a contact operation that contacts a rear end of the stacked sheets;

a driving unit configured to move said grasping member; and a control unit configured to control said driving unit so that said grasping member performs the contact operation after the sheets are stacked on said stacking unit so as to align the sheets stacked on said stacking unit in a sheet conveyance direction, and to control said driving unit so that said grasping member performs the grasping operation when a following sheet is stacked on the stacked sheets, wherein said control unit does not make said grasping member perform the contact operation when basis weight of the sheet is less than a predetermined value.

5. The sheet processing apparatus according to claim 4, wherein said control unit makes said grasping member perform the contact operation to align the sheets stacked on said stacking unit in the sheet conveyance direction.

6. The sheet processing apparatus according to claim 4, wherein said control unit makes said grasping member perform the grasping operation to prevent a collision between the rear end of the sheet stacked on said stacking unit and the front end of the following sheet.

7. A sheet processing apparatus comprising:

a conveyance unit configured to convey a sheet;

a stacking unit configured to stack a plurality of sheets that are conveyed by said conveyance unit;

a grasping member configured to perform a grasping operation that grasps a sheet surface in a rear end side of the sheets stacked on said stacking unit and a contact operation that contacts a rear end of the stacked sheets;

a driving unit configured to move said grasping member; and a control unit configured to control said driving unit so that said grasping member performs the contact operation after the sheets are stacked on said stacking unit so as to align the sheets stacked on said stacking unit in a sheet conveyance direction, and to control said driving unit so that said grasping member performs the grasping operation when a following sheet is stacked on the stacked sheets, wherein said control unit makes said grasping member perform the contact operation when sheets of not less than the predetermined sheet number are stacked on said stacking unit, and does not make said grasping member perform the contact operation when sheets of less than the predetermined sheet number are stacked on said stacking unit or when a single sheet is stacked on said stacking unit.

8. The sheet processing apparatus according to claim 7, wherein said control unit makes said grasping member perform the contact operation to align the sheets stacked on said stacking unit in the sheet conveyance direction.

9. The sheet processing apparatus according to claim 7, wherein said control unit makes said grasping member perform the grasping operation to prevent a collision between the rear end of the sheet stacked on said stacking unit and the front end of the following sheet.

* * * * *